US010495111B2

(12) United States Patent
Nithsdale

(10) Patent No.: US 10,495,111 B2
(45) Date of Patent: Dec. 3, 2019

(54) COMPRESSOR STAGE

(71) Applicant: ROLLS-ROYCE plc, London (GB)

(72) Inventor: Lee Nithsdale, Nottingham (GB)

(73) Assignee: ROLLS-ROYCE PLC, London (GB)

( * ) Notice: Subject to any disclaimer, the term of this patent is extended or adjusted under 35 U.S.C. 154(b) by 2 days.

(21) Appl. No.: 15/794,559

(22) Filed: Oct. 26, 2017

(65) Prior Publication Data

US 2018/0135652 A1 May 17, 2018

(30) Foreign Application Priority Data

Nov. 16, 2016 (GB) ..... 1619357.5

(51) Int. Cl.
*F04D 29/64* (2006.01)
*F04D 29/52* (2006.01)
*F04D 29/54* (2006.01)

(52) U.S. Cl.
CPC ..... *F04D 29/644* (2013.01); *F04D 29/522* (2013.01); *F04D 29/542* (2013.01)

(58) Field of Classification Search
CPC ..... F04D 29/644; F04D 29/522; F04D 29/542
USPC ..... 415/209.3
See application file for complete search history.

(56) References Cited

U.S. PATENT DOCUMENTS 6,062,813 A * 5/2000 Halliwell ..... F01D 9/04 415/173.1
7,445,426 B1 * 11/2008 Matheny ..... F01D 9/042 415/135
8,206,090 B2 * 6/2012 Cloarec ..... F01D 11/001 415/160
2007/0172349 A1 * 7/2007 Abgrall ..... F01D 9/041 415/191

FOREIGN PATENT DOCUMENTS

| | | |
|---|---|---|
| EP | 0844369 | 5/1998 |
| EP | 2204552 | 7/2010 |
| EP | 2549121 | 1/2013 |
| FR | 3008455 | 1/2016 |

OTHER PUBLICATIONS

Great Britain Search Report dated Apr. 18, 2017, issued in Great Britain Application No. 1619357.5.

* cited by examiner

*Primary Examiner* — Joseph J Dallo
*Assistant Examiner* — Yi-Kai Wang
(74) *Attorney, Agent, or Firm* — Oliff PLC

(57) ABSTRACT

A compressor stage of a gas turbine engine is provided. The compressor stage has a circumferential row of static vanes and a radially outer casing. Each vane has a radially outer and forwardly projecting front tenon which on build of the compressor stage is received into a first recess of the casing. Each vane also has a radially outer and rearwardly projecting rear tenon which on build of the compressor stage is received into a second recess of the casing. Each vane further has a baulking tab adjacent one of the front and the rear tenons. The casing has a respective baulking land adjacent the recess into which the other of the front and the rear tenons is received. The baulking tab and the baulking land are configured such that if the vane is attempted to be installed in the stage back-to-front, the baulking tab interferes with the baulking land to prevent completion of the build of the compressor stage.

7 Claims, 4 Drawing Sheets

COMPRESSOR STAGE

CROSS-REFERENCE TO RELATED APPLICATIONS

This specification is based upon and claims the benefit of priority from UK Patent Application Number 1619357.5 filed on 16 Nov. 2016, the entire contents of which are incorporated herein by reference.

BACKGROUND OF THE DISCLOSURE

1. Field of the Disclosure

The present disclosure relates to a compressor stage of a gas turbine engine, and to a static vane of such a stage.

2. Description of the Related Art

An axial compressor of a gas turbine engine consists of one or more rotor assemblies that carry rotor blades of aerofoil cross-section. The rotor assemblies are located by bearings, which are supported by the casing structure of the engine. The casing structure supports stator vanes, also of aerofoil cross-section, which are axially spaced behind the rotor blades. Each rotor assembly and its downstream stator row forms a stage of the compressor. A given compressor may have plural such stages with the rows of rotor blades and stator vanes alternating along the axial length of the compressor.

Particularly, in high pressure compressors the stator vanes can be static vanes of a type which are attached to the radially outer casing of the compressor stage by tenons extending from the vanes and corresponding recesses formed in the casing. For example, FIG. 1 shows a conventional attaching arrangement in which a radially outer and forwardly projecting front tenon 103 of a static vane 100 is received into a first recess 105 formed by a front outer casing section 101, and a radially outer and rearwardly projecting rear tenon 104 of the static vane is received into a second recess 106 of a rear outer casing section 102.

The compressor is typically built from front to rear so that the front casing section 101 is installed first, followed by the row of static vanes 100, and then followed by the rear casing section 102. It is essential that on build the static vanes are not installed back-to-front. To prevent this happening, the front tenon 103 and the first recess 105 are provided radially inwardly of the rear tenon 104 and the second recess 106. However, having the tenons at different radii increases the overall radius of the outer casing which in turn increases the weight of the casing and its thermal mass. In particular, having a high thermal mass in the casing can make it more problematic to tune the thermal response of the casing in order to optimise rotor blade tip clearances. In addition, having the tenons at different radii can sometimes cause stress and lifing issues for the vanes.

It would thus be desirable to provide a different arrangement for preventing back-to-front installation of static vanes.

BRIEF SUMMARY OF THE DISCLOSURE

Accordingly, in a first aspect, the present disclosure provides a compressor stage of a gas turbine engine, the compressor stage having a circumferential row of static vanes and a radially outer casing, wherein each vane has a radially outer and forwardly projecting front tenon which on build of the compressor stage is received into a first recess of the casing, and each vane has a radially outer and rearwardly projecting rear tenon which on build of the compressor stage is received into a second recess of the casing;

wherein each vane further has a baulking tab adjacent one of the front and the rear tenons, and the casing has a respective baulking land adjacent the recess into which the other of the front and the rear tenons is received, the baulking tab and the baulking land being configured such that if the vane is attempted to be installed in the stage back-to-front, the baulking tab interferes with the baulking land to prevent completion of the build of the compressor stage. The baulking tab projects radially outwardly further than the radial position of the baulking land to produce the interference.

Advantageously, by adopting this baulking tab and baulking land arrangement, the overall radius of the outer casing can be reduced, thereby reducing its weight and its thermal mass.

In a further aspect, the disclosure provides a gas turbine engine having at least one compressor containing one or more compressor stages according to the first aspect.

In a further aspect, the disclosure provides one of the static vanes of the compressor stage according to the first aspect.

Optional features of the disclosure will now be set out. These are applicable singly or in any combination with any aspect of the disclosure.

The front and rear tenons may be located at substantially the same radial distance from the engine axis.

The casing may have a front casing section which provides the first recess and a rear casing section which provides the second recess. Thus, on build of the compressor stage, one of the casing sections (e.g. the front casing section) can be installed first, followed by the vanes, and then followed by the other of the casing sections. In such an arrangement, the baulking tab may be adjacent the tenon which is received in the recess of the casing section which is installed last. In this way, build completion of the compressor stage can be prevented early in the build procedure (i.e. on installation of the vanes and before the other casing section is attempted to be installed) if an attempt is made to install the vanes back-to-front.

The compressor stage may be a stage of a high pressure compressor of the engine, as this is where static vanes are commonly used. However, this is not to exclude that the compressor stage could be a stage of a low or intermediate pressure compressor.

BRIEF DESCRIPTION OF THE DRAWINGS

Embodiments of the disclosure will now be described by way of example with reference to the accompanying drawings in which.

DETAILED DESCRIPTION OF THE DISCLOSURE

Figure 1:
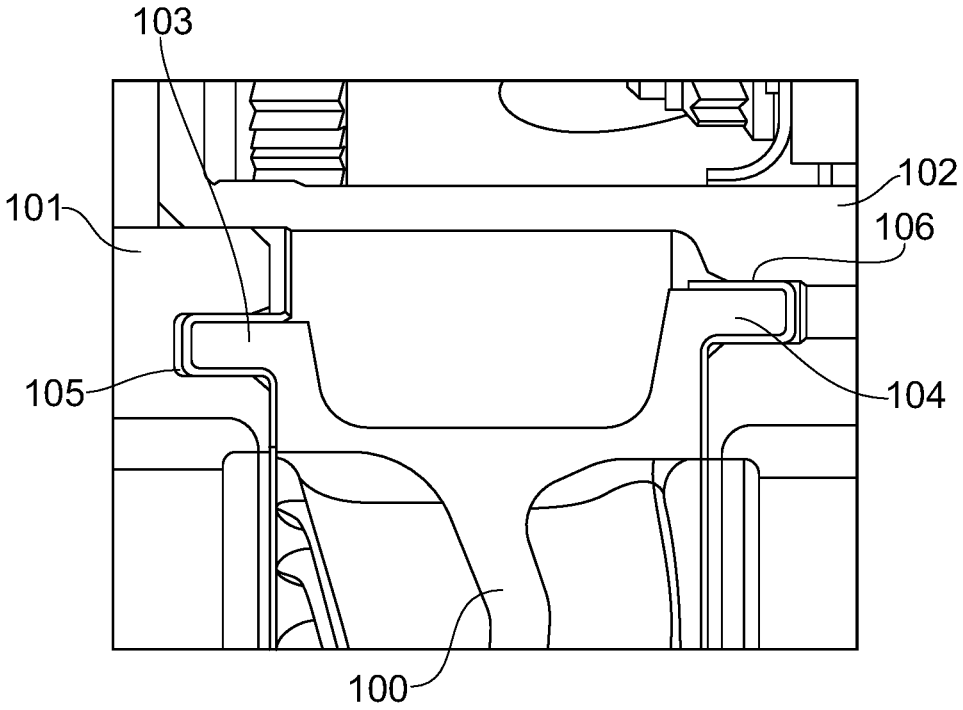
FIG. 1 shows schematically a radially outer portion of a conventional static vane and a corresponding portion of a casing structure.
Figure 2:
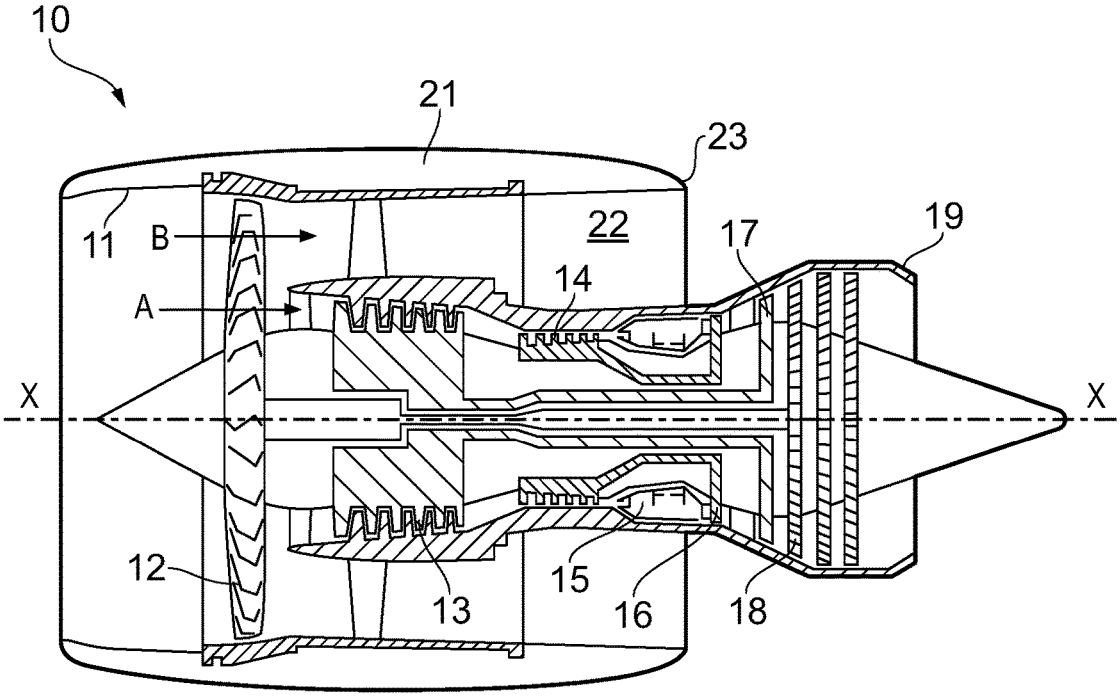
FIG. 2 shows a longitudinal cross-section through a ducted fan gas turbine engine.

With reference to FIG. 2, a ducted fan gas turbine engine incorporating the disclosure is generally indicated at 10 and has a principal and rotational axis X-X. The engine comprises, in axial flow series, an air intake 11, a propulsive fan 12, an intermediate pressure compressor 13, a high-pressure compressor 14, combustion equipment 15, a high-pressure turbine 16, an intermediate pressure turbine 17, a low-pressure turbine 18 and a core engine exhaust nozzle 19. A nacelle 21 generally surrounds the engine 10 and defines the intake 11, a bypass duct 22 and a bypass exhaust nozzle 23.

During operation, air entering the intake 11 is accelerated by the fan 12 to produce two air flows: a first air flow A into the intermediate-pressure compressor 13 and a second air flow B which passes through the bypass duct 22 to provide propulsive thrust. The intermediate-pressure compressor 13 compresses the air flow A directed into it before delivering that air to the high-pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate-pressure compressors 14, 13 and the fan 12 by suitable interconnecting shafts.

Figure 3:
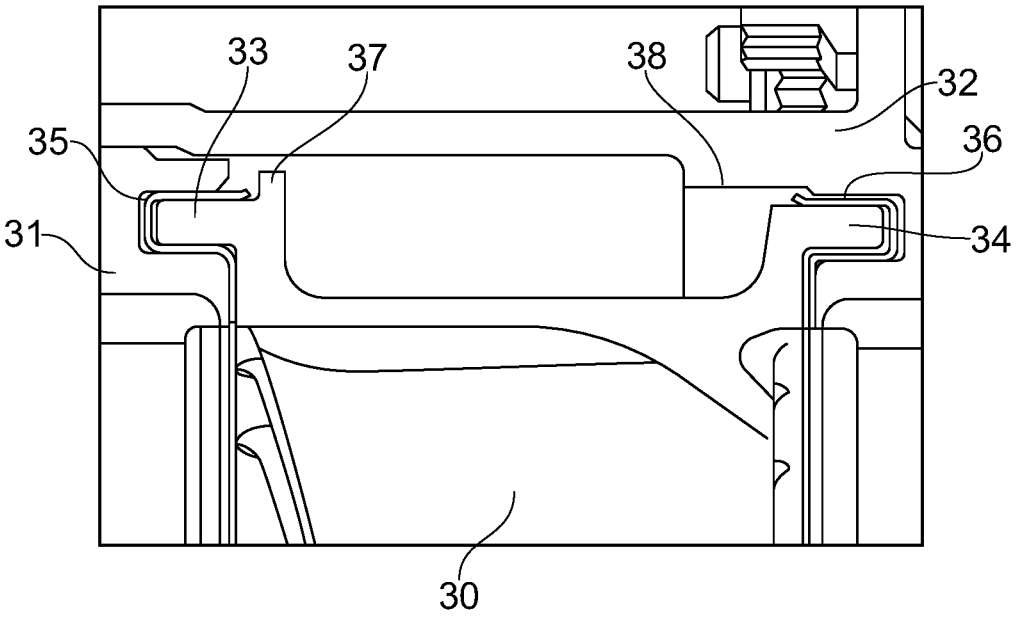
FIG. 3 shows schematically a radially outer portion of a static vane and a corresponding portion of a casing structure.

The high pressure compressor 14 has plural stages, each containing a row of rotor blades followed by a row static vanes which are attached to a radially outer casing of the stage by tenons extending from the vanes and corresponding recesses formed in the casing. FIG. 3 shows in more detail a radially outer and forwardly projecting front tenon 33 of one of the static vanes 30 received into a first recess 35 formed by a front outer casing section 31, and a radially outer and rearwardly projecting rear tenon 34 of the static vane received into a second recess 36 of a rear outer casing section 32. The stage is built from front to back, i.e. with the front casing section installed first, followed by the static vanes, and then by the rear casing section. The disclosure may relate to any stator vane in the gas turbine engine 10, for example from the high pressure compressor 14 or the intermediate pressure compressor 13.

Figure 4:
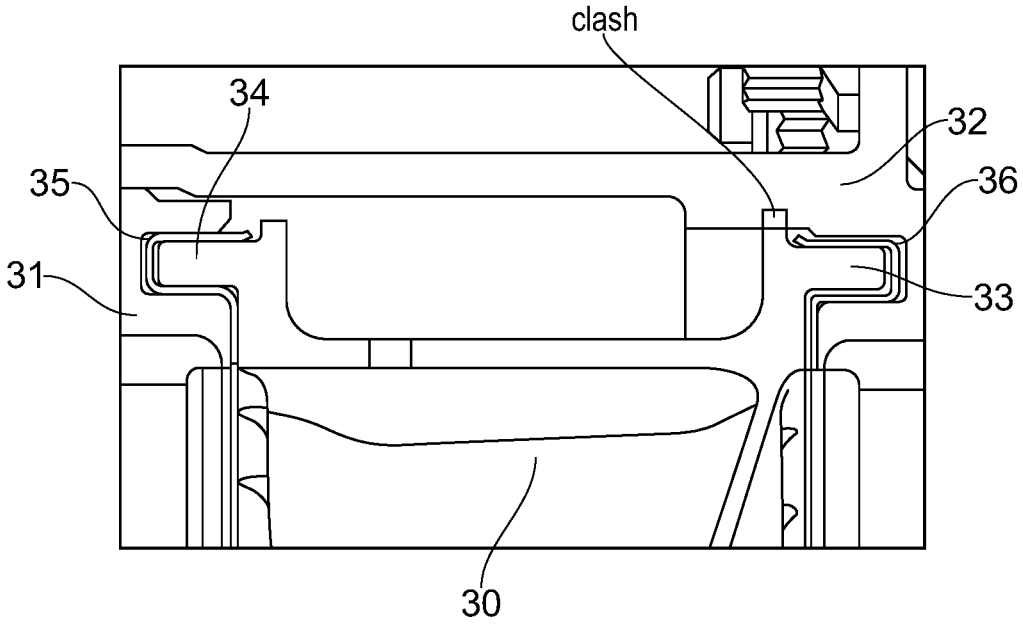
FIG. 4 shows schematically the static vane the casing structure of FIG. 3 when the vane is attempted to be installed back-to-front.

The vane 30 also has a baulking tab 37 adjacent the front tenon 33, while the rear casing section 32 has a respective baulking land 38 adjacent the second recess 36. These baulking features are configured with the baulking tab projecting radially outwardly further than the radial position of the baulking land, such that if the vanes were installed back-to-front, the baulking tab of each vane would clash with its baulking land when the rear casing section was attempted to be installed, thereby preventing build completion of the stage, as shown schematically in FIG. 4. In contrast, when the vanes are installed the correct way round, as shown in FIG. 3, the baulking tab does not interfere with the front casing section 31, and the baulking land does not interfere with the insertion of the rear tenon 34 into the second recess.

Advantageously, the front 33 and rear 34 tenons can be located at substantially the same radial distance from the engine axis, reducing the overall radius of the outer casing and reducing its thermal mass.

In an alternative arrangement, the baulking tab could be provided adjacent the rear tenon, and the baulking land adjacent the first recess. In this way, if the vanes were attempted to be installed back-to-front, this incorrect installation would be apparent and build completion prevented immediately on the attempted installation of the vanes.

While the disclosure has been described in conjunction with the exemplary embodiments described above, many equivalent modifications and variations will be apparent to those skilled in the art when given this disclosure. For example, the baulking lands can form a circumferentially continuous feature of the casing or may be discrete, circumferentially spaced lands. Similarly, when all the vanes are installed, the baulking tabs can form a circumferentially continuous feature, or can be circumferentially spaced from each other. Accordingly, the exemplary embodiments of the disclosure set forth above are considered to be illustrative and not limiting. Various changes to the described embodiments may be made without departing from the spirit and scope of the disclosure.

What is claimed is:

1. A compressor stage of a gas turbine engine, the compressor stage having a circumferential row of static vanes and a radially outer casing, wherein each vane has a radially outer and forwardly projecting front tenon which on build of the compressor stage is received into a first recess of the casing, and each vane has a radially outer and rearwardly projecting rear tenon which on build of the compressor stage is received into a second recess of the casing;

each vane further has a baulking tab adjacent one of the front and the rear tenons, and the casing has a respective baulking land adjacent the recess into which the other of the front and the rear tenons is received, the baulking tab and the baulking land being configured such that if the vane is attempted to be installed in the stage back-to-front, the baulking tab interferes with the baulking land to prevent completion of the build of the compressor stage;

the baulking tab projects radially outwardly further than the radial position of the baulking land to produce the interference;

the casing has a front casing section which provides the first recess and a rear casing section which provides the second recess; and on build of the compressor stage, one of the casing sections is installed first, followed by the vanes, and then followed by the other of the casing sections.

2. The compressor stage according to claim 1, wherein the front and rear tenons are located at substantially the same radial distance from an engine axis.

3. The compressor stage according to claim 1, wherein the baulking tab is adjacent the tenon which is received in the recess of the casing section which is installed last.

4. The compressor stage according to claim 1, wherein the front casing section is installed first.

5. The compressor stage according to claim 1 which is stage of a high pressure compressor of the engine.

6. A gas turbine engine having at least one compressor containing one or more compressor stages according to claim 1.

7. One of the static vanes of the compressor stage according to claim 1.

* * * * *